US008253673B2

(12) United States Patent
Hsu et al.

(10) Patent No.: US 8,253,673 B2
(45) Date of Patent: Aug. 28, 2012

(54) LIQUID CRYSTAL DISPLAY DEVICE CAPABLE OF REDUCING IMAGE FLICKER AND METHOD FOR DRIVING THE SAME

(75) Inventors: Chao-Ching Hsu, Hsin-Chu (TW); Mu-Lin Tung, Hsin-Chu (TW); Jen-Chieh Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 401 days.

(21) Appl. No.: 12/577,700

(22) Filed: Oct. 12, 2009

(65) Prior Publication Data

US 2010/0245333 A1 Sep. 30, 2010

(30) Foreign Application Priority Data

Mar. 24, 2009 (TW) ..... 98109623 A

(51) Int. Cl.
*G09G 3/36* (2006.01)

(52) U.S. Cl. ..... 345/92; 345/95

(58) Field of Classification Search ..... 345/87, 345/92, 95, 98, 100
See application file for complete search history.

(56) References Cited

U.S. PATENT DOCUMENTS

| | | | | |
|---|---|---|---|---|
| 6,075,505 | A | 6/2000 | Shiba | |
| 6,583,777 | B2 * | 6/2003 | Hebiguchi et al. | 345/92 |
| 7,027,024 | B2 | 4/2006 | Yanagi | |
| 2006/0077163 | A1 * | 4/2006 | Yanagi et al. | 345/94 |
| 2008/0225035 | A1 | 9/2008 | Hsu | |
| 2009/0189883 | A1 * | 7/2009 | Chung et al. | 345/213 |
| 2010/0289785 | A1 * | 11/2010 | Sawabe | 345/208 |

FOREIGN PATENT DOCUMENTS

| | | | |
|---|---|---|---|
| CN | 1544975 | A | 11/2004 |
| CN | 101315749 | A | 12/2008 |
| TW | I253051 | | 4/2006 |

* cited by examiner

*Primary Examiner* — Chanh Nguyen
*Assistant Examiner* — Jonathan Blancha
(74) *Attorney, Agent, or Firm* — Winston Hsu; Scott Margo

(57) ABSTRACT

A method for driving a liquid crystal display adjusts the falling edges of the gate driving signals for reducing image flicker. A first gate driving signal falls from a high level to a first level at the signal falling edge. A second gate driving signal falls from the high level to a second level at the signal falling edge. When the parasitic capacitance of a first pixel is larger than that of a second pixel, the first level is lower than the second level; when the parasitic capacitance of the first pixel is substantially the same as that of the second pixel, the first level is the same as the second level; when the parasitic capacitance of the first pixel is smaller than that of the second pixel, the first level is higher than the second level.

20 Claims, 10 Drawing Sheets

LIQUID CRYSTAL DISPLAY DEVICE CAPABLE OF REDUCING IMAGE FLICKER AND METHOD FOR DRIVING THE SAME

BACKGROUND OF THE INVENTION

1. Field of the Invention

The present invention is related to a liquid crystal display device and method for driving the same, and more particularly, to a liquid crystal display device capable of reducing image flicker and method for driving the same.

2. Description of the Prior Art

Liquid crystals display (LCD) devices, characterized in low radiation, small size and low power consumption, have gradually replaced traditional cathode ray tube (CRT) devices and been widely used in electronic products, such as notebook computers, personal digital assistants (PDAs), flat panel TVs, or mobile phones. In traditional LCD devices, a source driver and a gate driver are used for driving the pixels of the panel in order to display images. Since the source driver is more expensive than the gate driver, LCD devices adopting half source driver (HSD) structure have been developed in order to reduce the number of source drivers. In other words, for the same amount of pixels, the manufacturing cost can be reduced by halving the number of data lines receiving signals from the source driver and doubling the number of gate lines receiving signals from the gate driver.

FIG. 1 is a prior art LCD device 100 which adopts HSD structure. The LCD device 100 includes a timing controller 130, a source driver 110, a gate driver 120, a plurality of data lines $DL_1$-$DL_m$, a plurality of gate lines $GL_1$-$GL_n$, and a pixel matrix. The pixel matrix includes a plurality of pixel units $PX_L$ and $PX_R$ each having a thin film transistor (TFT) switch, a liquid crystal capacitor $C_{LC}$ and a storage capacitor $C_{ST}$, and respectively coupled to a corresponding data line, a corresponding gate line and a common node. The timing controller 130 can generate control signals YOE and YV1C, input clock signals CK and CKB or an output enable signal OE for operating the source driver 110 and the gate driver 20. The source driver 110 can generate data driving signals $SD_1$-$SD_m$ corresponding to display images. If the gate driver 120 is an external driving circuit, the gate driving signals $SG_1$-$SG_n$ for turning on the TFT switches are generated according to the control signals YOE and YV1C; if the gate driver 120 is fabricated using gate on array (GOA) technique, the gate driving signals $SG_1$-$SG_n$ are generated according to the input clock signals CK,CKB and the output enable signal OE.

When the TFT switch is turned off, the pixel electrode is not connected to any voltage source and thus has a floating level. Any voltage variation around the pixel electrode is coupled to the pixel electrode via its parasite capacitance, which in turn influences the voltages applied to the liquid crystal capacitor $C_{LC}$ and the storage capacitor $C_{ST}$. The feed-through voltage $V_{FD}$ due to voltage variations caused by parasite capacitance can be represented by the following equation:

$$V_{FD}=[C_{GD}/(C_{LC}+C_{ST}+C_{GD})]*\Delta V_G=K*\Delta V_G$$

$C_{GD}$ represents the parasite capacitance between the gate and the drain of the TFT switch. K represents the percentage of $C_{GD}$ which contributes to the overall parasite capacitance. $\Delta V_G$ represents the gate voltage difference caused by a gate driving signal when turning off a corresponding TFT switch. The parasite capacitance is an inherent characteristic of the TFT switch. In order to effectively reduce image flicker, the gate voltage difference $\Delta V_G$ needs to be lowered first before adjusting the common voltage Vcom for compensating the feed-through voltage $V_{FD}$.

FIGS. 2 and 3 are diagrams illustrating methods for driving the prior art LCD device 100. FIG. 2 shows the waveforms of the control signal YOE and the gate driving signals $SG_1$-$SG_4$ when the gate driver 120 is an external circuit. FIG. 3 shows the waveforms of the clock signals CK, CKB, O_CK, O_CKB, the output enable signal OE and the gate driving signals $SG_1$-$SG_4$ when the gate driver 120 is fabricated using GOA technique.

In the driving method depicted in FIG. 2, the length of the enable period in the gate driving signals $SG_1$-$SG_4$ is determined by the pulse width of the control signal YOE, and the length of the signal falling time in the gate driving signals $SG_1$-$SG_4$ is determined by the signal falling start point of the control signals YOE and YV1C. In each period, the control signal YOE remains at high level for a constant length, and the waveform of the control signal YV1C starts to fall at the same point. Therefore, the gate driving signals $SG_1$-$SG_4$ result in an identical gate voltage difference $\Delta V_G'$ when turning off corresponding TFT switches. As previously stated, the feed-through voltage is proportional to the gate voltage difference. Since the gate voltage difference $\Delta V_G'$ after voltage trimming is smaller than the gate voltage difference $\Delta V_G$ without voltage trimming, the effect of the feed-through voltage can be compensated.

In the driving method depicted in FIG. 3, the clock signals CK and CKB having opposite phases switch between high/low voltage levels based on a predetermined period which determines the length of the enable period in the gate driving signals $SG_1$-$SG_4$. When the output enable signal OE is at high level, the gate driver 120 outputs the clock signals CK and CKB for providing the corresponding clock signals O_CK and O_CKB. When the output enable signal OE is at low level, the gate driver 120 stops outputting the clock signals CK and CKB. Charge-sharing is then performed between the clock signals O_CK and O_CKB, thereby achieving voltage trimming at the signal falling edge. The gate driving signals $SG_1$-$SG_4$ can thus be provided according to the clock signals O_CK and O_CKB after charge-sharing. In each period, the output enable signal OE remains at low level for a constant length T, the degree of voltage trimming in the gate driving signals $SG_1$-$SG_4$ is identical. Therefore, the gate driving signals $SG_1$-$SG_4$ result in an identical gate voltage difference $\Delta V_G'$ when turning off corresponding TFT switches. As previously stated, the feed-through voltage is proportional to the gate voltage difference. Since the gate voltage difference $\Delta V_G'$ after voltage trimming is smaller than the gate voltage difference $\Delta V_G$ without voltage trimming, the effect of the feed-through voltage can be compensated.

In the prior art LCD device 100, the pixel units are disposed on both sides of each data line, wherein the pixel units $PX_L$ disposed on the left side of the data lines are controlled by the gate driving signals $SG_1, SG_3, \ldots, SG_{n-1}$ transmitted from the odd-numbered gate lines, while the pixel units $PX_R$ disposed on the right side of the data lines are controlled by the gate driving signals $SG_2, SG_4, \ldots, SG_n$ transmitted from the even-numbered gate lines. Normally adopting different designs, these two types of pixel units $PX_L$ and $PX_R$ have different $C_{LC}$, $C_{ST}$, $C_{GS}$ or $C_{GD}$, and the value of the feed-through voltage $V_{FD}$ also varies. Even if the two types of pixel units $PX_L$ and $PX_R$ adopt the same design, the value of the feed-through voltage $V_{FD}$ may also vary due to characteristic shift caused by manufacturing process deviations, For example, the process shift between the first metal layer M1 and the second metal layer M2 may result in different $C_{GD}$ values of the pixel units $PX_L$ and $PX_R$.

In the driving methods depicted in FIGS. 2 and 3, the gate voltage difference of each pixel is lowered by the same degree. Since each pixel has different feed-through voltage, image flicker can not be effectively reduced by adjusting the common voltage Vcom.

SUMMARY OF THE INVENTION

The present invention provides an LCD device which improves image flicker, comprising a first gate line for transmitting a first gate driving signal; a second gate line adjacent and parallel to the first gate line for transmitting a second gate driving signal; a data line perpendicular to the first and second gate lines for transmitting data driving signals; a first pixel disposed at an intersection of the data line and the first gate line and on a first side of the data line, and for displaying images according to the first gate driving signal and a received data driving signal; a second pixel disposed at an intersection of the data line and the second gate line and on a second side of the data line, and for displaying images according to the second gate driving signal and a received data driving signal; a trimming circuit for generating a trimming signal according to the parasite capacitances of the first and second pixels; and a gate driver for generating the first and second gate driving signals by adjusting a signal falling edge of a gate pulse signal according to the trimming signal, wherein a signal falling edge of the first gate driving signal falls from a high level to a first level, and a signal falling edge of the second gate driving signal falls from the high level to a second level.

The present invention also provides a method for driving an LCD device which comprises a data line, two adjacent first and second gate lines, a first pixel disposed at an intersection of the data line and the first gate line and on a first side of the data line, and a second pixel disposed at an intersection of the data line and the second gate line and on a second side of the data line. The method comprises providing a gate pulse signal; generating a first gate driving signal by adjusting the gate pulse signal according to a parasite capacitance of the first pixel, wherein a signal falling edge of the first gate driving signal falls from a high level to a first level; generating a second gate driving signal by adjusting the gate pulse signal according to a parasite capacitance of the second pixel, wherein a signal falling edge of the second gate driving signal falls from the high level to a second level; and outputting the first and second gate driving signals to the first and second gate lines for driving the first and second pixels, respectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
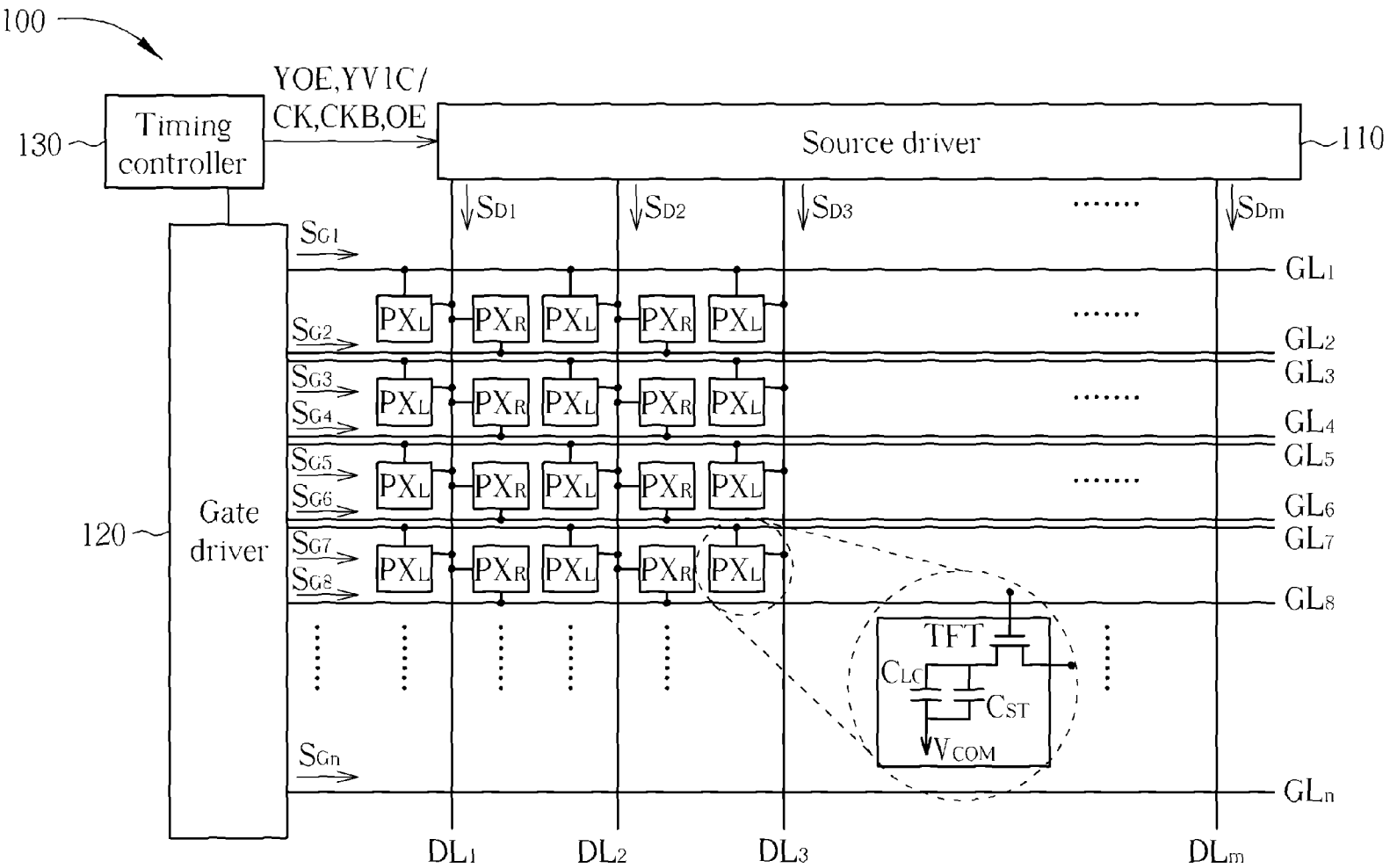
FIG. 1 PRIOR ART
FIG. 1 is a diagram of a prior art LCD device which adopts HSD structure.
Figure 2:
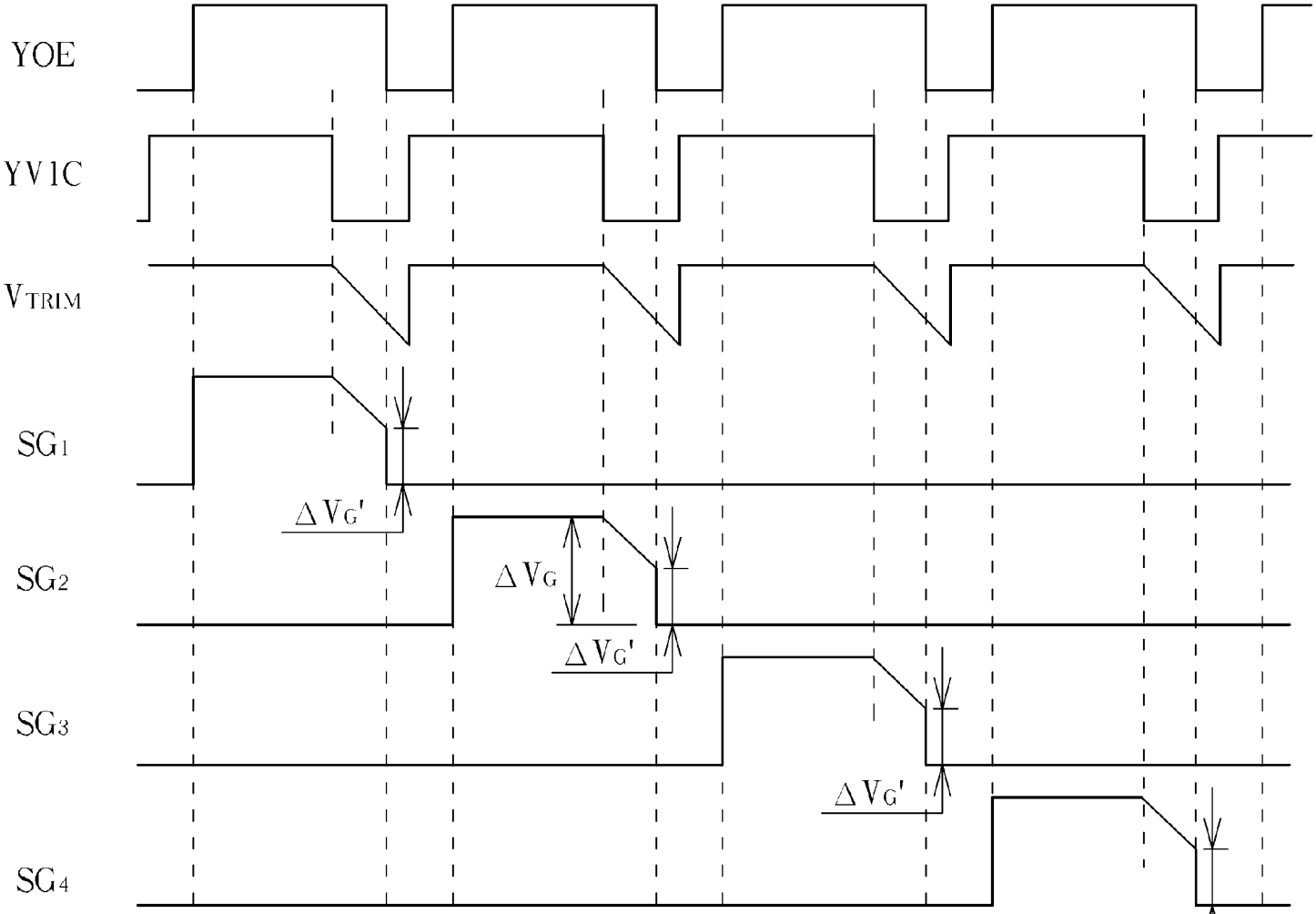
FIG. 2 PRIOR ART
FIGS. 2 and 3 are diagrams illustrating methods for driving the prior art LCD device.
Figure 3:
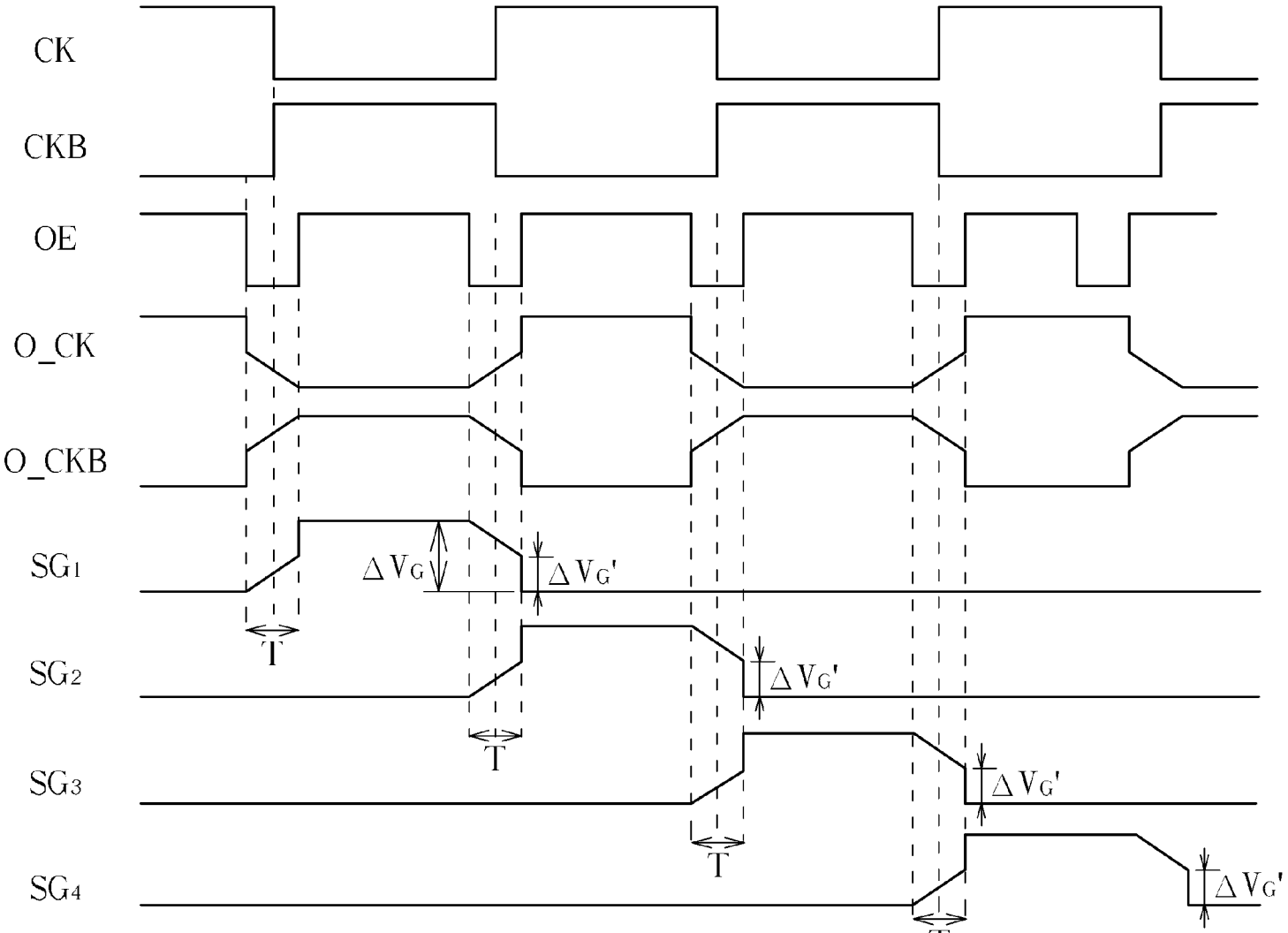
FIG. 3 PRIOR ART
Figure 4:
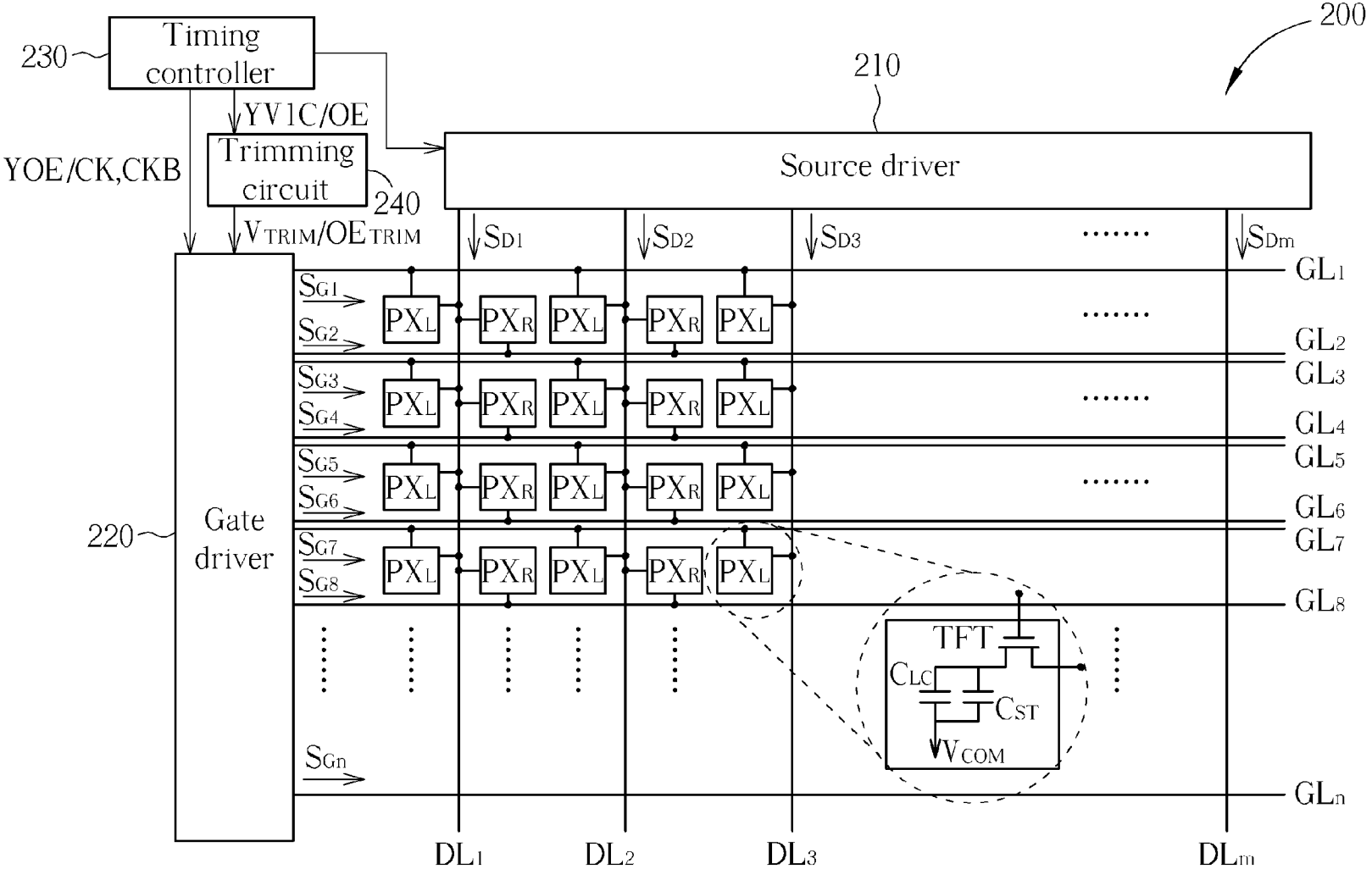
FIGS. 4 and 5 are diagrams of LCD devices which adopt HSD structure according to the present invention.
Figure 5:
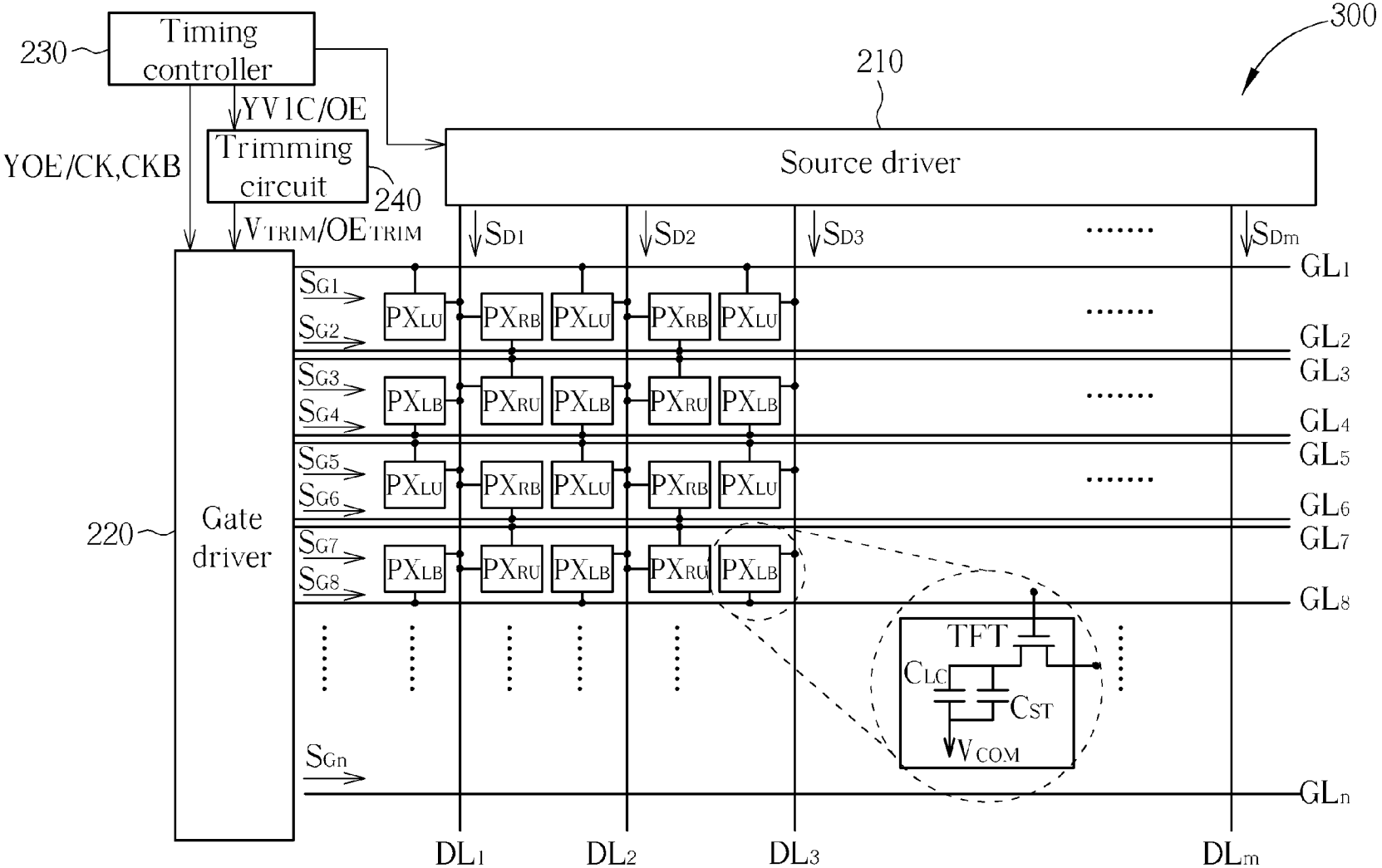

FIGS. 4 and 5 are diagrams of LCD devices 200 and 300 which adopt HSD structure according to the present invention. The LCD devices 200 and 300 each include a source driver 210, a gate driver 220, a timing controller 230, a trimming circuit 240, a plurality of data lines $DL_1$-$DL_m$, a plurality of gate lines $GL_1$-$GL_n$, and a pixel matrix. The pixel matrix of the LCD device 200 includes a plurality of pixel units $PX_L$ and $PX_R$, and the pixel matrix of the LCD device 300 includes a plurality of pixel units $PX_{LU}$, $PX_{LB}$, $PX_{RU}$ and $PX_{RB}$. Each of the pixel units includes a TFT switch, a liquid crystal capacitor $C_{LC}$ and a storage capacitor $C_{ST}$ respectively coupled to a corresponding data line, a corresponding gate line and a common node. The timing controller 230 can generate control signals YOE and YV1C, clock signals CK and CKB or an output enable signal OE for operating the source driver 210 and the gate driver 220. The source driver 210 can generate data driving signals $SD_1$-$SD_m$ corresponding to display images. If the gate driver 220 is an external driving circuit, the trimming circuit 240 generates a trimming signal $V_{TRIM}$ according to the control signal YV1C and the parasite capacitance of the pixel units, and the gate driver 220 then generates the gate driving signals $SG_1$-$SG_n$ for turning on the TFT switches according to the control signal YOE and the trimming signal $V_{TRIM}$; if the gate driver 220 is fabricated using GOA technique, the trimming circuit 240 generates a trimming signal $V_{TRIM}$ according to the output enable signal OE and the parasite capacitance of the pixel units, and the gate driver 220 then generates the gate driving signals $SG_1$-$SG_n$ for turning on the TFT switches according to the clock signals CK, CKB and the trimming signal $V_{TRIM}$.

In the LCD device 200 according to the present invention, the pixel units are disposed on both sides of each data line, wherein the first type of pixel units $PX_L$ disposed on the left side of the data lines are controlled by the gate driving signals $SG_1, SG_3, \ldots, SG_{n-1}$ transmitted from the odd-numbered gate lines, while the second type of pixel units $PX_R$ disposed on the right side of the data lines are controlled by the gate driving signals $SG_2, SG_4, \ldots, SG_n$ transmitted from the even-numbered gate lines. Normally adopting different designs, these two types of pixel units $PX_L$ and $PX_R$ have different $C_{LC}$, $C_{ST}$, $C_{GS}$ or $C_{GD}$/and the value of the feed-through voltage $V_{FD}$ also varies. Even if the two types of pixel units $PX_L$ and $PX_R$ adopt the same design, the value of the feed-through voltage $V_{FD}$ may also vary due to characteristic shift caused by manufacturing process deviations.

In the LCD device 300 according to the present invention, the pixel units are disposed on both sides of each data line, wherein the first type of pixel units $PX_{LU}$ disposed on the left side of the data lines are controlled by the gate driving signals $SG_1, SG_5, \ldots, SG_{n-3}$ transmitted from the gate lines $GL_1, GL_5, \ldots, GL_{n-3}$, the second type of pixel units $PX_{RB}$ disposed on the right side of the data lines are controlled by the gate driving signals $SG_2, SG_6, \ldots, SG_{n-2}$ transmitted from the gate lines $GL_2, GL_6, \ldots, GL_{n-2}$, the third type of pixel units $PX_{RU}$ disposed on the right side of the data lines are controlled by the gate driving signals $SG_3, SG_7, \ldots, SG_{n-1}$ transmitted from the gate lines $GL_3, GL_7, \ldots, GL_{n-1}$, the fourth type of pixel units $PX_{LB}$ disposed on left side of the data lines are controlled by the gate driving signals $SG_4, SG_8, \ldots, SG_n$ transmitted from the gate lines $GL_4, GL_8, \ldots, GL_n$ (assuming n is a multiple of 4). Normally adopting different designs, these four types of pixel units $PX_{LU}$, $PX_{LB}$, $PX_{RU}$ and $PX_{RB}$ have different $C_{LC}$, $C_{ST}$, $C_{GS}$ or $C_{GD}$/and the value of the feed-through voltage $V_{FD}$ also varies. Even if the four types of pixel units $PX_{LU}$, $PX_{LB}$, $PX_{RU}$ and $PX_{RB}$ adopt the same design, the value of the feed-through voltage $V_{FD}$ may also vary due to characteristic shift caused by manufacturing process deviations.

In the present invention, the gate driving signals $SG_1$-$SG_n$ with trimmed signal falling edges are used for reducing the gate voltage differences. Meanwhile, the degree of voltage trimming is adjusted according to the parasite capacitance of the pixel units, so that the gate driving signals $SG_1$-$SG_n$ result in various gate voltage differences $\Delta V_{G1}$-$\Delta V_{Gn}$ when turning off corresponding TFT switches. In the LCD device 300 for instance, the gate driving signals $SG_1$-$SG_4$ with different trimmed signal falling edges are used for driving the four types of pixel units, thereby resulting in various gate voltage differences $\Delta V_{G1}$-$\Delta V_{G4}$ when turning off corresponding TFT switches. The capacitance percentages $K_1$-$K_4$ of the four types of the pixel units which influence the feed-through voltage differently can thus be compensated. Since the feed-through voltages $V_{FD1}$-$\Delta V_{FD4}$ of the four types of the pixel units are substantially the same after voltage trimming, image flicker can be effectively reduced.

Figure 6:
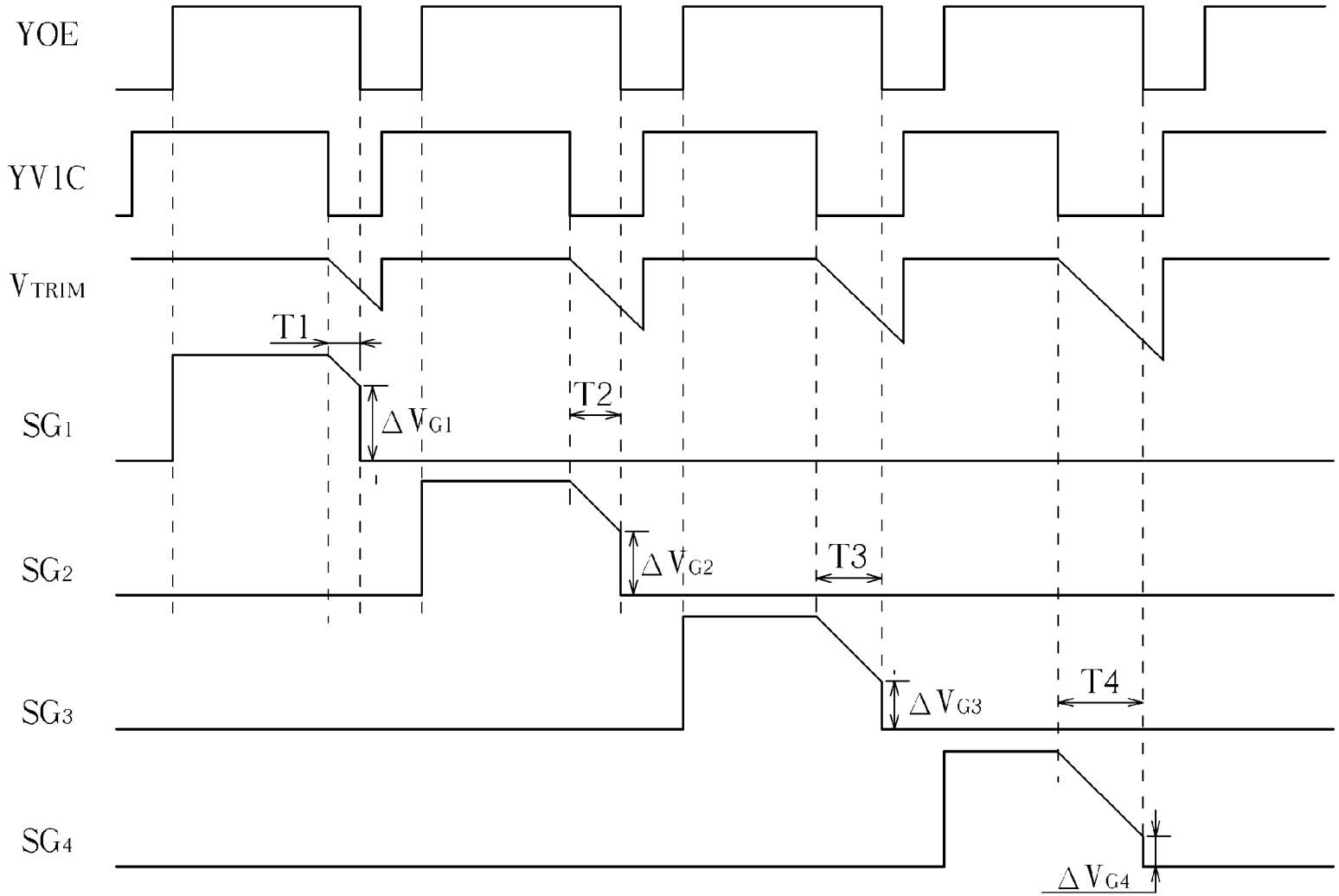
FIG. 6 is a timing diagram illustrating a method for driving the LCD device according to a first embodiment of the present invention.

FIG. 6 is a timing diagram illustrating a method for driving the LCD device 200 or 300 when the gate driver 310 is an external driving circuit according to a first embodiment of the present invention. FIG. 6 shows the waveforms of the control signal YOE and YV1C, the trimming signal $V_{TRIM}$ and the gate driving signals $SG_1$-$SG_4$. In the driving method depicted in FIG. 6, the control signal YOE remains at high level for a constant length in each period, and the length of the enable period in the gate driving signals $SG_1$-$SG_4$ is determined by the pulse width of the control signal YOE. The signal falling edge start points in each period of the control signal YV1C vary according to the parasite capacitances of the pixel units. The total lengths of the signal falling time T1-T4 of the gate driving signals $SG_1$-$SG_4$ are determined by the signal falling start points of the control signals YOE and YV1C in corresponding periods. The trimming circuit 340 first generates the trimming signal $V_{TRIM}$ having distinct signal falling edge start points in corresponding periods according to the control signal YV1C and the capacitance percentages $K_1$-$K_4$. The gate driver 320 then generates the gate driving signals $SG_1$-$SG_4$ having distinct trimmed signal falling edges in corresponding periods according to the control signal YOE and the trimming signal $V_{TRIM}$. The gate driving signals $SG_1$-$SG_4$ result in different gate voltage differences $\Delta V_{G1}$-$\Delta V_{G4}$ when the control signal YOE switches from high level to low level. Assuming the relationship of the capacitance percentages is $K_1<K_2<K_3<K_4$, then the relationship of the total lengths of the signal falling time is T1<T2<T3<T4, and the relationship of the gate voltage differences is thus $\Delta V_{G1}>\Delta V_{G2}>\Delta V_{G3}>\Delta V_{G4}$. As previously stated, the feed-through voltage is proportional to the multiple of the capacitance percentage and the gate voltage difference. When $K_1<K_2<K_3<K_4$, the first embodiment of the present invention provides the gate driving signals $SG_1$-$SG_4$ which result in gate voltage differences having the relationship of $\Delta V_{G1}>\Delta V_{G2}>\Delta V_{G3}>\Delta V_{G4}$. Since the feed-through voltages of each type of pixel units are substantially the same after voltage trimming, image flicker can be effectively reduced by adjusting the common voltage Vcom.

Figure 7:
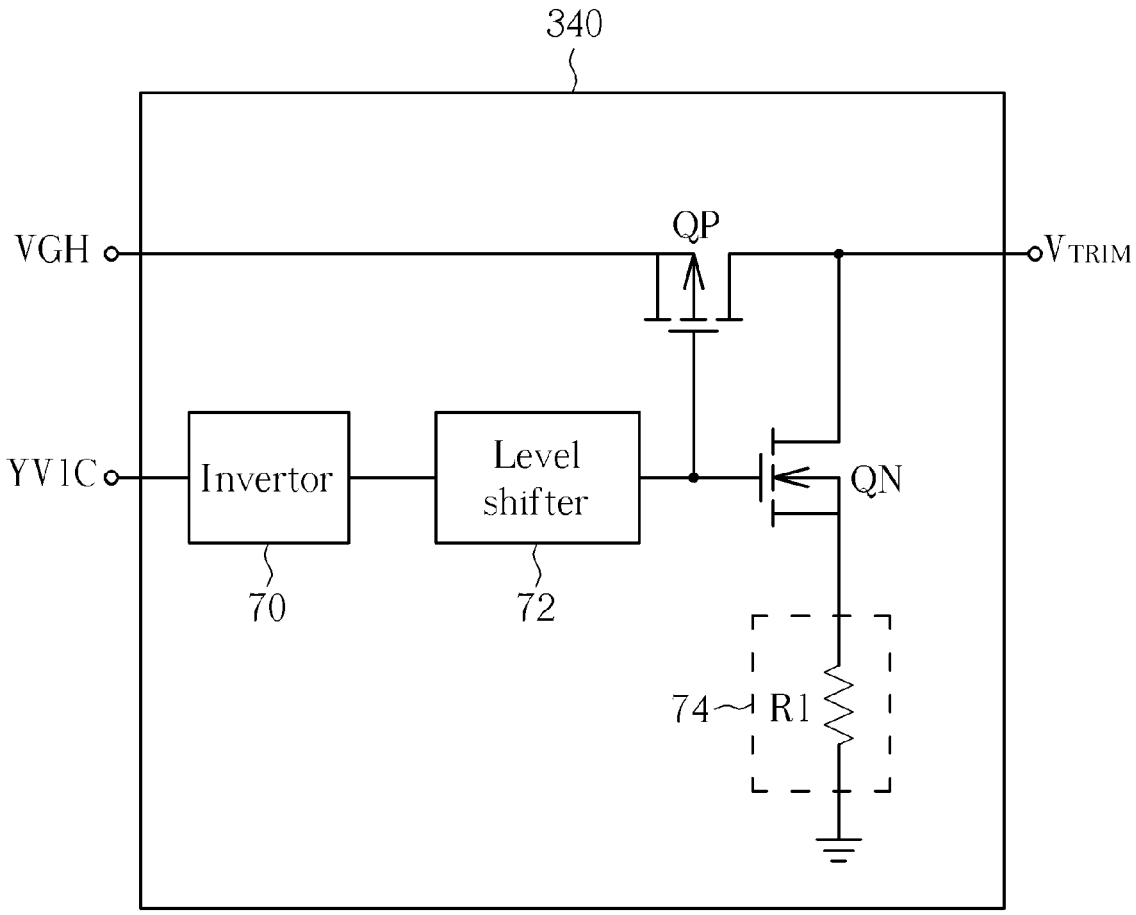
FIG. 7 is a diagram illustrating the trimming circuit capable of performing the driving method according to the first embodiment of the present invention.

FIG. 7 is a diagram illustrating the trimming circuit 340 capable of performing the driving method according to the first embodiment of the present invention. The trimming circuit 340 in FIG. 7, including an inverter 70, a level shifter 72, a slope-adjusting circuit 74, and transistor switches QP and QN, can generate the trimming signal $V_{TRIM}$ according to the control signal YV1C. When the control signal YV1C is at high level, the transistor switch QP is turned on and the transistor switch QN is turned off, and the trimming signal $V_{TRIM}$ is at a high level VGH. When the control signal YV1C is at low level, the transistor switch QP is turned off and the transistor switch QN is turned on, and the level of the trimming signal $V_{TRIM}$ is pulled down to low level via the resistor R1 of the slope-adjusting circuit 74. Therefore in the embodiments of FIGS. 6 and 7, the trimming circuit 340 receives the control signal YV1C having distinct signal falling edge start points, and then provides the trimming signal $V_{TRIM}$ having a slope at the signal falling edge. The slope-adjusting circuit 74 can be an impedance device, such as a resistor or a variable resistor.

Figure 8:
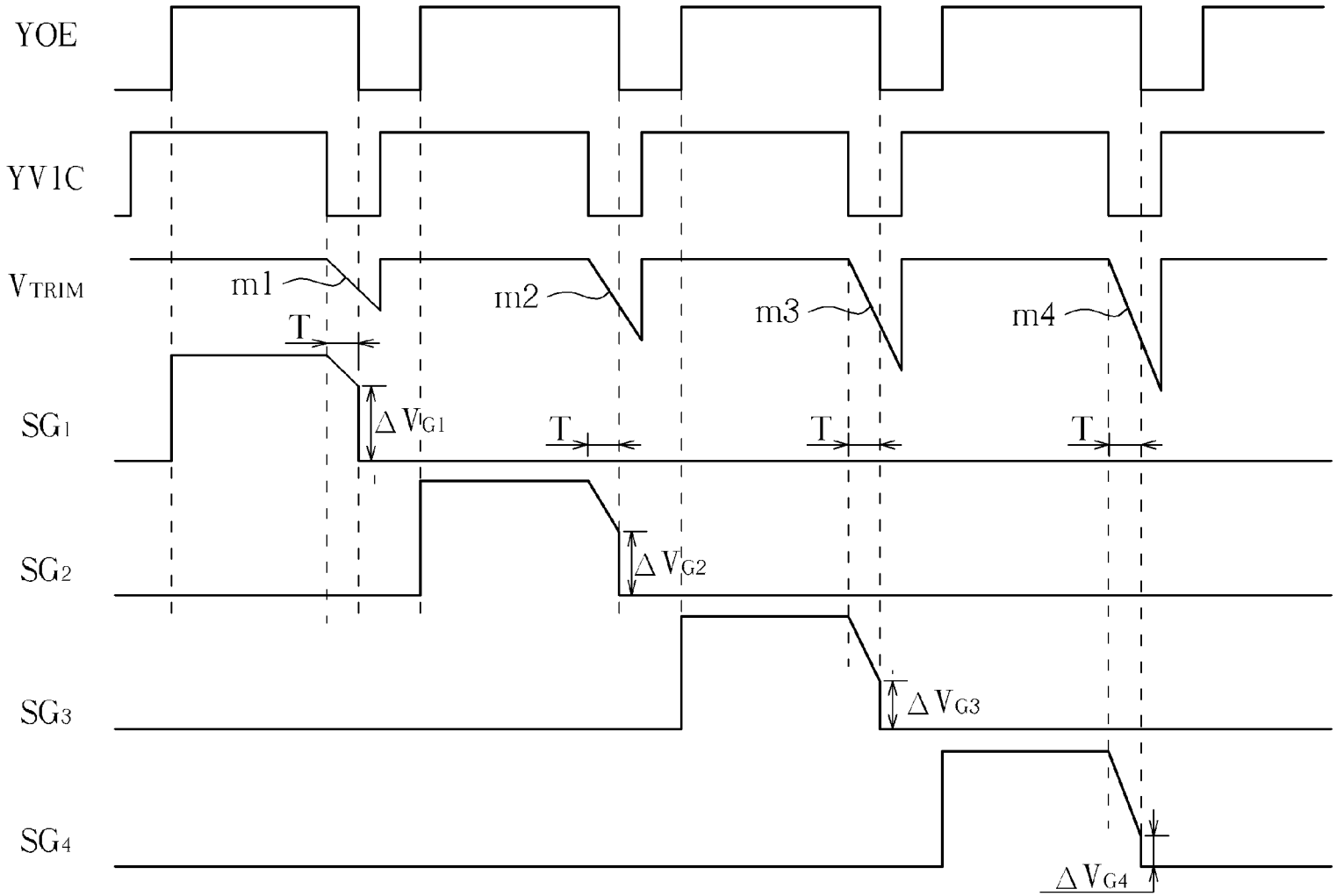
FIG. 8 is a timing diagram illustrating a method for driving the LCD device according to a second embodiment of the present invention.

FIG. 8 is a timing diagram illustrating a method for driving the LCD device 200 or 300 when the gate driver 310 is an external driving circuit according to a second embodiment of the present invention. FIG. 8 shows the waveforms of the control signal YOE and YV1C, the trimming signal $V_{TRIM}$ and the gate driving signals $SG_1$-$SG_4$. In the driving method depicted in FIG. 8, the control signal YOE remains at high level for a constant length in each period, and the length of the enable period in the gate driving signals $SG_1$-$SG_4$ is determined by the pulse width of the control signal YOE. The signal falling edge start points in each period of the control signal YV1C vary according to the parasite capacitances of the pixel units. The waveform of the control signal YV1C starts to fall at the same point in each period, thereby resulting in an identical total length of the signal falling time T in the gate driving signals $SG_1$-$SG_4$. The slopes $m_1$-$m_4$ of the signal falling edges in the gate driving signals $SG_1$-$SG_4$ are determined by the trimming circuit 340. The trimming circuit 340 first generates the trimming signal $V_{TRIM}$ having distinct signal falling edge slopes in corresponding periods according to the control signal YV1C and the capacitance percentages $K_1$-$K_4$. The gate driver 320 then generates the gate driving signals $SG_1$-$SG_4$ having distinct trimmed signal falling edges in corresponding periods according to the control signal YOE and the trimming signal $V_{TRIM}$. The gate driving signals $SG_1$-$SG_4$ result in different gate voltage differences $\Delta V_{G1}$-$\Delta V_{G4}$ when the control signal YOE switches from high level to low level. Assuming the relationship of the capacitance percentages is $K_1<K_2<K_3<K_4$, then the relationship of the signal falling edge slopes is $m_1<m_2<m_3<m_4$, and the relationship of the gate voltage differences is thus $\Delta V_{G1}>\Delta V_{G2}>\Delta V_{G3}>\Delta V_{G4}$. As previously stated, the feed-through voltage is proportional to the multiple of the capacitance percentage and the gate voltage difference. When $K_1<K_2<K_3<K_4$, the second embodiment of the present invention provides the gate driving signals $SG_1$-$SG_4$ which result in gate voltage differences having the relationship of $\Delta V_{G1}>\Delta V_{G2}>\Delta V_{G3}>\Delta V_{G4}$. Since the feed-through voltages of each type of pixel units are substantially the same after voltage trimming, image flicker can be effectively reduced by adjusting the common voltage Vcom.

Figure 9:
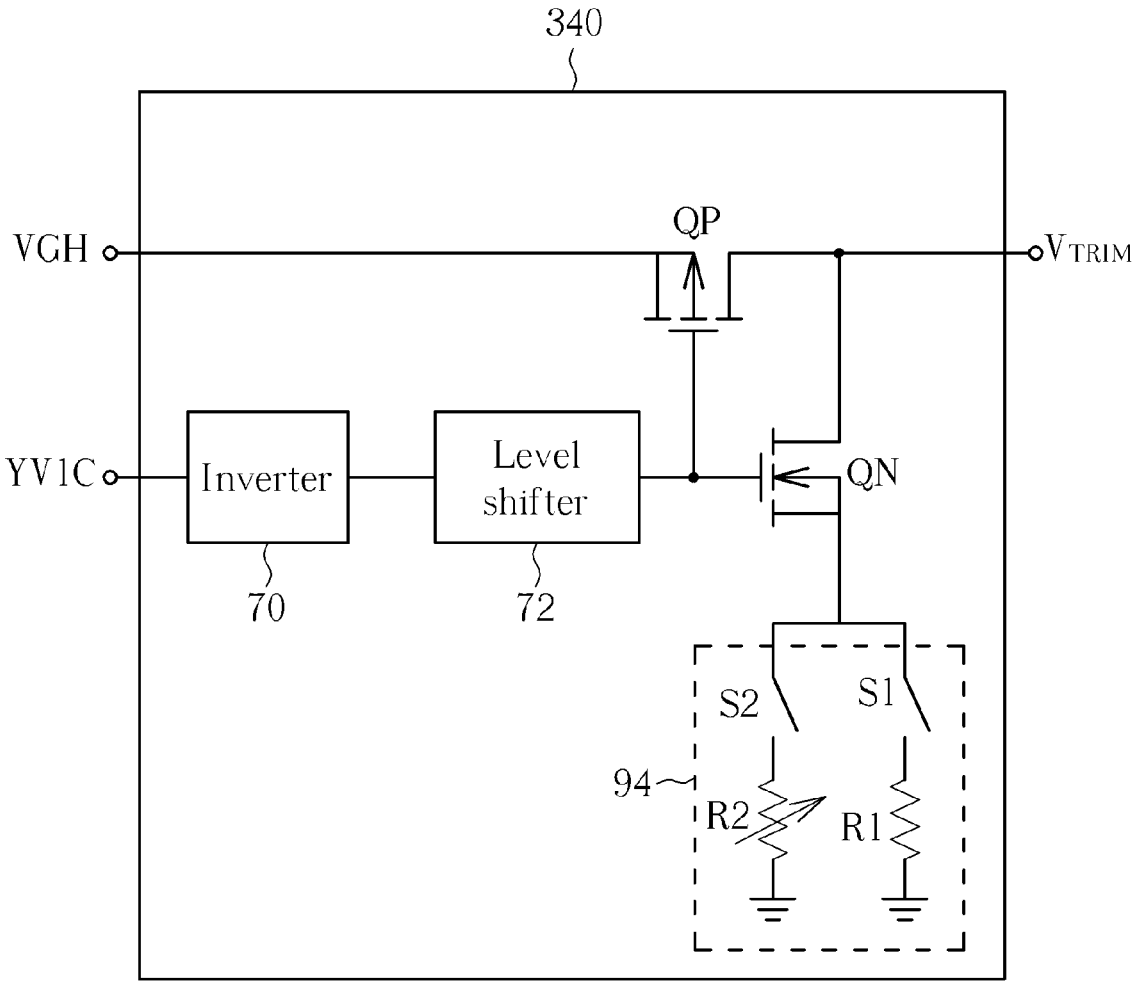
FIG. 9 is a diagram illustrating the trimming circuit capable of performing the driving method according to the second embodiment of the present invention.

FIG. 9 is a diagram illustrating the trimming circuit 340 capable of performing the driving method according to the second embodiment of the present invention. The trimming circuit 340 in FIG. 9, including an inverter 70, a level shifter 72, a slope-adjusting circuit 94, and transistor switches QP and QN, can generate the trimming signal $V_{TRIM}$ according to the control signal YV1C. When the control signal YV1C is at high level, the transistor switch QP is turned on and the transistor switch QN is turned off, and the trimming signal $V_{TRIM}$ is at a high level VGH. When the control signal YV1C is at low level, the transistor switch QP is turned off and the transistor switch QN is turned on, and the level of the trimming signal $V_{TRIM}$ is pulled down to low level via the resistor R1 of the slope-adjusting circuit 94. The slope-adjusting circuit 94, including a resistor R1, a variable resistor R2, and switches S1 and S2, can provide different equivalent resistances according to the capacitance percentages $K_1$*$K_4$ and can pull down the level of the trimming signal $V_{TRIM}$ using an adequate slope. Therefore in the embodiments of FIGS. 8 and 9, the trimming circuit 340 receives the control signal YV1C having identical signal falling edge start points, and then provides the trimming signal $V_{TRIM}$ having distinct slopes at the signal falling edge using the slope-adjusting circuit 94.

Figure 10:
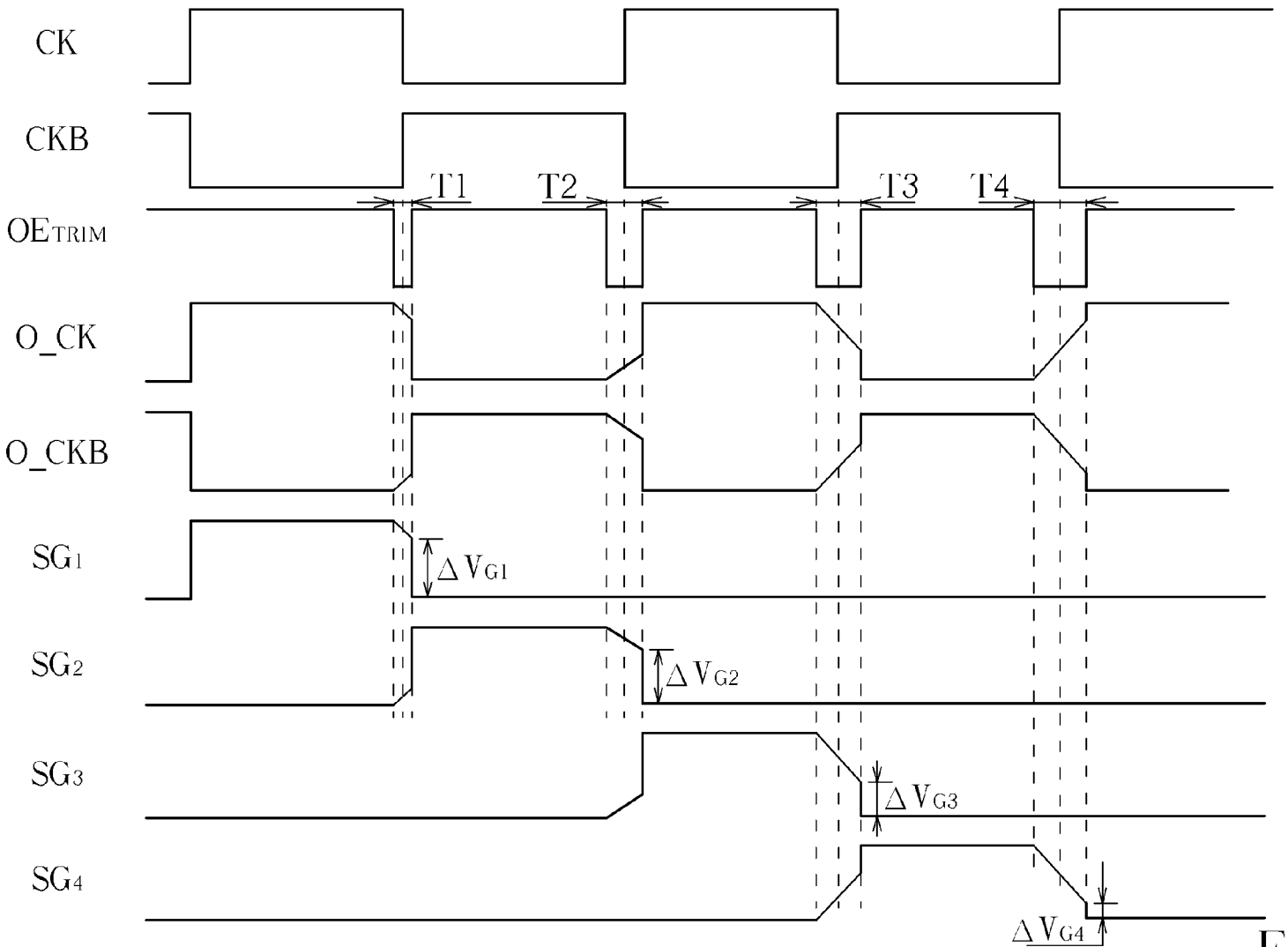
FIG. 10 is a timing diagram illustrating a method for driving the LCD device according to a third embodiment of the present invention.

FIG. 10 is a timing diagram illustrating a method for driving the LCD device 200 or 300 when the gate driver 310 is fabricated using GOA technique according to a third embodiment of the present invention. FIG. 10 shows the waveforms of the clock signals CK, CKB, O_CK and O_CKB, the output enable signal OE and the gate driving signals $SG_1$-$SG_4$. In the driving method depicted in FIG. 8, the clock signals CK and CKB having opposite phases switch between high/low voltage levels based on a predetermined period which determines the length of the enable period in the gate driving signals $SG_1$-$SG_4$. The trimming circuit 340 first generates a trimming signal $OE_{TRIM}$ having distinct disable lengths (low level) T1-T4 in corresponding periods according to the enable signal OE and the capacitance percentages $K_1$-$K_4$. The gate driver 320 then outputs the clock signals CK and CKB for providing the clock signals O_CK and O_CKB. When the trimming signal $OE_{TRIM}$ is at high level, the gate driver 220 outputs the clock signals CK and CKB for providing the corresponding clock signals O_CK and O_CKB. When the trimming signal $OE_{TRIM}$ is at low level, the gate driver 220 stops outputting the clock signals CK and CKB. Charge-sharing is then performed between the clock signals O_CK and O_CKB, thereby achieving voltage trimming at the signal falling edge. The gate driver 320 then generates the gate driving signals $SG_1$-$SG_4$ having distinct trimmed signal falling edges in corresponding periods according to the clock signals OCK and O_CKB.

The gate driving signals $SG_1$-$SG_4$ result in different gate voltage differences $\Delta V_{G1}$-$\Delta V_{G4}$ when the corresponding clock signals O_CK and O_CKB switch from high level to low level. Assuming the relationship of the capacitance percentages is $K_1<K_2<K_3<K_4$, then the relationship of the disable lengths is T1<T2<T3<T4, and the relationship of the gate voltage differences is thus $\Delta V_{G1}>\Delta V_{G2}>\Delta V_{G3}>\Delta V_{G4}$. As previously stated, the feed-through voltage is proportional to the multiple of the capacitance percentage and the gate voltage difference. When $K_1<K_2<K_3<K_4$, the third embodiment of the present invention provides the gate driving signals $SG_1$-$SG_4$ which result in gate voltage differences having the relationship of $\Delta V_{G1}>\Delta V_{G2}>\Delta V_{G3}>\Delta V_{G4}$. Since the feed-through voltages of each type of pixel units are substantially the same after voltage trimming, image flicker can be effectively reduced by adjusting the common voltage Vcom.

The present invention can adjust the total length or the slope of the signal falling edge in the gate driving signals $SG_1$-$SG_4$ according to the capacitance percentages $K_1$-$K_n$ of the pixel units. Different parasite capacitances can be compensated by various voltage differences $\Delta V_{G1}$-$\Delta V_{Gn}$ so that the feed-through voltages of each type of pixel units are substantially the same. The present invention can effectively reduce image flicker the by adjusting the common voltage Vcom, and thus provide better display quality.

Those skilled in the art will readily observe that numerous modifications and alterations of the device and method may be made while retaining the teachings of the invention.

What is claimed is:

1. A liquid crystal display (LCD) device which improves image flicker, comprising:

a first gate line for transmitting a first gate driving signal;

a second gate line adjacent and parallel to the first gate line for transmitting a second gate driving signal;

a data line perpendicular to the first and second gate lines for transmitting data driving signals;

a first pixel disposed at an intersection of the data line and the first gate line and on a first side of the data line for displaying images according to the first gate driving signal and a received data driving signal;

a second pixel disposed at an intersection of the data line and the second gate line and on a second side of the data line for displaying images according to the second gate driving signal and a received data driving signal;

a trimming circuit for generating a trimming signal according to parasitic capacitances of the first and second pixels; and a gate driver for generating the first and second gate driving signals by adjusting a signal falling edge of a gate pulse signal according to the trimming signal, wherein:

a signal falling edge of the first gate driving signal falls from a high level to a first level;

a signal falling edge of the second gate driving signal falls from the high level to a second level;

the first level is lower than the second level when the parasitic capacitance of the first pixel is larger than the parasitic capacitance of the second pixel;

the first and second levels are substantially the same when the parasitic capacitances of the first and second pixels are substantially the same; and the first level is higher than the second level when the parasitic capacitance of the first pixel is smaller than the parasitic capacitance of the second pixel.

2. The LCD device of claim 1, wherein:

the first pixel comprises:

a first switch including:

a first end coupled to the data line;

a second end; and a control end coupled to the first gate line;

a first liquid crystal capacitor coupled between the second end of the first switch and a common node; and a first storage capacitor coupled in parallel with the first liquid crystal capacitor; and the second pixel comprises:

a second switch including:

a first end coupled to the data line;

a second end; and a control end coupled to the second gate line;

a second liquid crystal capacitor coupled between the second end of the second switch and the common node; and a second storage capacitor coupled in parallel with the second liquid crystal capacitor.

3. The LCD device of claim 2, wherein the first and second switches include thin film transistors, and the parasitic capacitances of the first and second pixels are gate-to-drain capacitances of the thin film transistors.

4. The LCD device of claim 1 further comprising:

a third gate line adjacent and parallel to the second gate line for transmitting a third gate driving signal;

a fourth gate line adjacent and parallel to the third gate line for transmitting a fourth gate driving signal;

a third pixel disposed at an intersection of the data line and the third gate line and on the first side of the data line for displaying images according to the third gate driving signal and a received data driving signal; and a fourth pixel disposed at an intersection of the data line and the fourth gate line and on the second side of the data line for displaying images according to the fourth gate driving signal and a received data driving signal;

wherein the trimming circuit further generates the trimming signal according to parasitic capacitances of the third and fourth pixels, and the gate driver further generates the third and fourth gate driving signals by adjusting the signal falling edge of the gate pulse signal according to the trimming signal, wherein:

a signal falling edge of the third gate driving signal falls from the high level to a third level;

a signal falling edge of the fourth gate driving signal falls from the high level to a fourth level;

the third level is lower than the fourth level when the parasitic capacitance of the third pixel is larger than the parasitic capacitance of the fourth pixel;

the third and fourth levels are substantially the same when the parasitic capacitances of the third and fourth pixels are substantially the same; and the third level is higher than the fourth level when the parasitic capacitance of the third pixel is smaller than the parasitic capacitance of the fourth pixel.

5. The LCD device of claim 4, wherein:

the third pixel comprises:

a third switch including:

a first end coupled to the data line;

a second end; and a control end coupled to the third gate line;

a third liquid crystal capacitor coupled between the second end of the third switch and a common node; and a third storage capacitor coupled in parallel with the third liquid crystal capacitor; and the fourth pixel comprises:

a fourth switch including:

a first end coupled to the data line;

a second end; and a control end coupled to the fourth gate line;

a fourth liquid crystal capacitor coupled between the second end of the fourth switch and the common node; and a fourth storage capacitor coupled in parallel with the fourth liquid crystal capacitor.

6. The LCD device of claim 5, wherein the third and fourth switches include thin film transistors, and the parasitic capacitances of the third and fourth pixels are gate-to-drain capacitances of the thin film transistors.

7. The LCD device of claim 1, further comprising:

a third gate line adjacent and parallel to the second gate line for transmitting a third gate driving signal;

a fourth gate line adjacent and parallel to the third gate line for transmitting a fourth gate driving signal;

a third pixel disposed at an intersection of the data line and the third gate line and on the second side of the data line for displaying images according to the third gate driving signal and a received data driving signal; and a fourth pixel disposed at an intersection of the data line and the fourth gate line and on the first side of the data line for displaying images according to the fourth gate driving signal and a received data driving signal;

wherein the trimming circuit further generates the trimming signal according to parasitic capacitances of the third and fourth pixels, and the gate driver further generates the third and fourth gate driving signals by adjusting the signal falling edge of the gate pulse signal according to the trimming signal, wherein:

a signal falling edge of the third gate driving signal falls from the high level to a third level, and a signal falling edge of the fourth gate driving signal falls from the high level to a fourth level;

the third level is lower than the fourth level when the parasitic capacitance of the third pixel is larger than the parasitic capacitance of the fourth pixel;

the third and fourth levels are substantially the same when the parasitic capacitances of the third and fourth pixels are substantially the same; and the third level is higher than the fourth level when the parasitic capacitance of the third pixel is smaller than the parasitic capacitance of the fourth pixel.

8. The LCD device of claim 7, wherein:

the third pixel comprises:

a third switch including:

a first end coupled to the data line;

a second end; and a control end coupled to the third gate line;

a third liquid crystal capacitor coupled between the second end of the third switch and a common node; and a third storage capacitor coupled in parallel with the third liquid crystal capacitor; and the fourth pixel comprises:

a fourth switch including:

a first end coupled to the data line;

a second end; and a control end coupled to the fourth gate line;

a fourth liquid crystal capacitor coupled between the second end of the fourth switch and the common node; and a fourth storage capacitor coupled in parallel with the fourth liquid crystal capacitor.

9. The LCD device of claim 8, wherein the third and fourth switches include thin film transistors, and the parasitic capacitances of the third and fourth pixels are gate-to-drain capacitances of the thin film transistors.

10. The LCD device of claim 1, wherein the trimming circuit comprises:

a switch for controlling a signal falling edge start point of the trimming signal in each period.

11. The LCD device of claim 1, wherein the trimming circuit comprises:

a resistor for controlling a signal falling slope of the trimming signal in each period.

12. A method for driving an LCD device which comprises a data line, two adjacent first and second gate lines, a first pixel disposed at an intersection of the data line and the first gate line and on a first side of the data line, and a second pixel disposed at an intersection of the data line and the second gate line and on a second side of the data line, the method comprising:

providing a gate pulse signal;

generating a first gate driving signal by adjusting the gate pulse signal according to a parasitic capacitance of the first pixel, wherein a signal falling edge of the first gate driving signal falls from a high level to a first level;

generating a second gate driving signal by adjusting the gate pulse signal according to a parasitic capacitance of the second pixel, wherein a signal falling edge of the second gate driving signal falls from the high level to a second level; and outputting the first and second gate driving signals to the first and second gate lines for driving the first and second pixels, respectively, wherein:

the first level is lower than the second level when the parasitic capacitance of the first pixel is larger than the parasitic capacitance of the second pixel;

the first and second levels are substantially the same when the parasitic capacitances of the first and second pixels are substantially the same; and the first level is higher than the second level when the parasitic capacitance of the first pixel is smaller than the parasitic capacitance of the second pixel.

13. The method of claim 12 wherein:

generating the first gate driving signal includes lowering the first gate driving signal from the high level for a first time length so as to reach the first level; and generating the second gate driving signal includes lowering the second gate driving signal from the high level for a second time length so as to reach the second level.

14. The method of claim 13 wherein:

the first time length is longer than the second time length when the parasitic capacitance of the first pixel is larger than the parasitic capacitance of the second pixel;

the first and second time lengths are substantially the same when the parasitic capacitances of the first and second pixels are substantially the same; and the first time length is shorter than the second time length when the parasitic capacitance of the first pixel is smaller than the parasitic capacitance of the second pixel.

15. The method of claim 12 wherein:

generating the first gate driving signal includes lowering the first gate driving signal from the high level with a first slope so as to reach the first level; and generating the second gate driving signal includes lowering the second gate driving signal from the high level with a second slope so as to reach the second level.

16. The method of claim 15 wherein the first slope is larger than the second slope when the parasitic capacitance of the first pixel is larger than the parasitic capacitance of the second pixel.

17. The method of claim 15 wherein the first and second slopes are substantially the same when the parasitic capacitances of the first and second pixels are substantially the same.

18. The method of claim 12 further comprising:

providing a first clock signal and a second clock signal, wherein the first and second clock signals switch phases based on a predetermined period, and the first and second clock signals have opposite phases at the same time;

determining a first time length according to the parasitic capacitance of the first pixel;

determining a second time length according to the parasitic capacitance of the second pixel;

performing charge-sharing on the first and second clock signals for the first time length during periods corresponding to the first pixels;

performing charge-sharing on the second and second clock signals for the second time length during periods corresponding to the second pixels; and generating the first or the second gate driving signal by adjusting the gate pulse signal according to the first and second clock signals after performing charge-sharing.

19. The method of claim 18 wherein the first time length is longer than the second time length when the parasitic capacitance of the first pixel is larger than the parasitic capacitance of the second pixel.

20. The method of claim 18 wherein the first and second time lengths are substantially the same when the parasitic capacitances of the first and second pixels are substantially the same.

* * * * *